US005123957A

United States Patent [19]

Kato et al.

[11] Patent Number: 5,123,957

[45] Date of Patent: Jun. 23, 1992

[54] METHOD FOR MANUFACTURING LOW CARBON FERROCHROME WITH HIGH CHROMIUM CONTENT

[75] Inventors: Masanori Kato; Toshio Kamatani; Keiichi Nakagawa; Kiyoshi Kawasaki; Yutaka Yano, all of Tokyo, Japan

[73] Assignee: NKK Corporation, Tokyo, Japan

[21] Appl. No.: 428,582

[22] Filed: Oct. 30, 1989

[30] Foreign Application Priority Data

Nov. 11, 1988 [JP] Japan ..... 63-285173
Mar. 9, 1989 [JP] Japan ..... 1-57174
Mar. 9, 1989 [JP] Japan ..... 1-57175

[51] Int. Cl.[5] ..... C21D 1/48

[52] U.S. Cl. ..... 75/416; 148/208; 148/513; 148/668; 420/71; 420/104; 75/623

[58] Field of Search ..... 148/14, 16.6; 75/623; 420/71, 104

[56] References Cited

U.S. PATENT DOCUMENTS 3,384,455 5/1968 Fuchs ..... 423/409
3,525,608 8/1970 Bryk ..... 75/623
4,417,927 11/1983 Fullman ..... 148/16.6

*Primary Examiner*—Peter D. Rosenberg
*Attorney, Agent, or Firm*—Frishauf, Holtz, Goodman & Woodward

[57] ABSTRACT

A method for manufacturing a low carbon ferrochrome with a high chromium content of at least 70 weight % Cr comprising the steps of at least once nitriding and crushing a low carbon ferrochrome to form a crushed ferrochrome nitride and subjecting the crushed ferrochrome nitride to an acid treatment comprising introducing the crushed ferrochrome nitride into an acid solution and stirring the resultant mixture of the ferrochrome nitride and the acid solution, to remove iron. The acid treated ferrochrome nitride is denitrided by heating in a vacuum.

19 Claims, 1 Drawing Sheet

METHOD FOR MANUFACTURING LOW CARBON FERROCHROME WITH HIGH CHROMIUM CONTENT

BACKGROUND OF THE INVENTION

1. Field of the Invention

The present invention relates to a method for manufacturing a low carbon ferrochrome with a high chromium content, and more particularly to a method for manufacturing ferrochrome which is added to a superalloy as a chromium source of a secondary component in the field of such superalloy as a nickel-based alloy, an iron-nickel-based alloy and a cobalt-based alloy.

2. Description of the Prior Art

High purity ferrochrome (containing 65 wt. % Cr or more) is added to a superalloy as a chromium source of a secondary component in the field of such superalloy as a nickel-based alloy, an iron-nickel-based alloy and cobalt-based alloy, and is indispensable for increasing corrosion resistance and the strength of superalloy. A great amount of high purity ferrochrome is used as a powdery additive material in the field of welding rod and powder metallurgy, the high purity ferrochrome being mixed with powdery iron or powdery nickel.

As the prior art methods for manufacturing high purity ferrochrome containing a high content of chromium, there are mainly, (a) the Perrin method, (b) the Swedish method, (c) the Multistage Perrin method and (d) other methods. Out of those methods, methods (a) and (b) are known as economical methods wherein high purity ferrochrome is manufactured in large quantities by the use of an electric furnace. The method (c) is a method wherein iron is removed from chromium ore under conditions of a weak reduction after a primary slag of chromium ore has been melted and low carbon ferrochrome is obtained by strongly reducing the secondary slag finally. In this method, low carbon ferrochrome having a high content of 85 to 90 wt. % Cr can be obtained. Further, the aluminium thermit method is considered as one of the other methods (d).

Chromium ore, which is economically available as a material, contains a high content of Fe. In consequence, in said Perrin method (a) and Swedish method (b), obtained is a a component of low carbon ferrochrome has the highest limit of 72 wt. % Cr. In the multistage Perrin method (c), ferrochrome having a high content of Cr can be obtained. There are difficulties in the multistage Perrin method (c) such that molten metal of a high melting point is hard to handle in a manufacturing process, that low carbon ferrochrome with a low content of Cr, which is produced in large quantities, is required to be processed, and that there are lots of impurities such as Si, O, N or the like in the product.

SUMMARY OF THE INVENTION

It is an object of the present invention to overcome the above-mentioned difficulties in the methods for manufacturing ferrochrome and to provide a method for manufacturing a low carbon ferrochrome having a high content of 70 to 99 wt. % Cr.

To accomplish the above-mentioned object, the present invention provides a method for manufacturing a low carbon ferrochrome with a high content chromium comprising:

at least once nitriding and crushing low carbon ferrochrome, crushed ferrochrome nitride being obtained;

subjecting said ferrochrome nitride to an acid treatment while stirring said ferrochrome nitride in an acid solution, ferrochrome nitride, from which iron has been removed, being obtained;

denitriding said ferrochrome nitride, from which iron has been removed, by heating said ferrochrome nitride in a vacuum.

The above objects and other objects and advantages of the present invention will become apparent from the detailed description which follows, taken in conjunction with the appended drawings.

DESCRIPTION OF THE PRESENT EMBODIMENT

Figure 1:
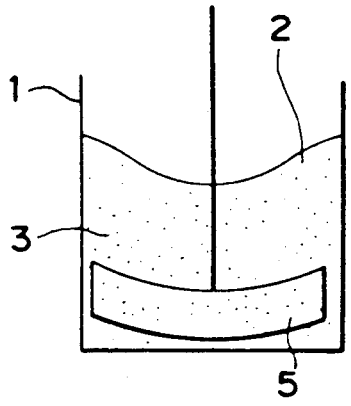
FIGS. 1 and 2 are schematic illustrations showing different ways of stirring in an acid treatment, respectively, in the examples of the present invention.

The method for manufacturing low carbon ferrochrome with a high chromium content according to the present invention comprises at least once nitriding and crushing low carbon ferrochrome, crushed ferrochrome nitride being obtained; subjecting said ferrochrome nitride to an acid treatment while stirring said ferrochrome nitride in an acid solution, ferrochrome nitride, from which iron has been removed, being obtained, and denitriding said ferrochrome nitride, from which iron has been removed, by heating said ferrochrome nitride in a vacuum.

Ferrochrome nitride obtained in a step of nitriding and crushing low carbon ferrochrome comprises a nitride phase of 77 to 81 wt. % Cr and metal phase containing mainly Fe and 10 to 20 wt. % Cr. Said a metal phase is effectively removed from ferrochrome nitride in an acid treatment and ferrochrome nitride having a high content of Cr can be obtained. Said ferrochrome nitride is denitrided and other impurities such as C, O and the like are removed from said ferrochrome nitride in the following reactions by mixing said ferrochrome nitride, having been subjected to the acid treatment, with carbonaceous material, denitriding a mixture of said ferrochrome nitride and carbonaceous material and heating the mixture in a vacuum.

$$Cr_2N(s) \rightarrow 2Cr(s) + \tfrac{1}{2}N_2(g)$$

$$C(s) + O(s) \rightarrow CO(g).$$

In the above equations, (s) means a solid and (g) a gas. These definitions will be used hereinafter. Ferrochrome obtained in this way is a high purity ferrochrome containing a high content of Cr.

In this Preferred Embodiment, low carbon ferrochrome containing 50 wt. % Cr or more and 1 wt. % C or less is used as material, but the a material may not be confined to such ferrochrome depending on material supply. When low carbon ferrochrome contains 50% Cr or less, an amount of Fe to be removed by means of the acid treatment increases. This decreases the efficiency in removal of the metal phase. When the content of C in the low carbon ferrochrome exceeds 1 wt. %, nitriding of the low carbon ferrochrome does not proceed smoothly. Said, low carbon ferrochrome is crushed mechanically into particles of 5 mm or less.

Those particles of low carbon ferrochrome are nitrided in a vacuum heating furnace by the use of a solid nitriding method. A degree of vacuum is 0.1 Torr and a temperature is from 1000° to 1300° C. in the vacuum heating furnace. Nitrogen gas is introduced into the vacuum heating furnace to nitride low carbon ferrochrome.

Ferrochrome nitride obtained in this way contains approximately 7 wt. % N. When said ferrochrome nitride is observed with a scanning electron microscope, it is seen that said ferrochrome nitride consists of two phases, one of which is a nitride phase of 77 to 81 wt. % Cr and the other of which is a metal phase containing Fe, 10 to 20 wt. % Cr, Si, Co, wherein Fe is a major component. Most of said metal phase is removed by crushing ferrochrome nitride into particles of 3 mm or less and subjecting the particles of ferrochrome nitride to the acid treatment and the nitride phase is recovered.

Lumps of high purity low carbon ferrochrome containing 70 to 95 wt. % Cr can be obtained by mixing nitride having been subjectd to the acid treatment with carbonaceous material and heating a mixture of said nitride and carbonaceous material at 1150° to 1350° C. in a vacuum. During the acid treatment and vacuum heating, the content of C, N, O, Si and Co is decreased and a high purity, low carbon ferrochrome can be obtained. Nitriding and crushing low carbon nitride, subjecting said ferrochrome nitride to the acid treatment and denitriding said ferrochrome nitride are naturally thought to be repeated more than twice for the purpose of increasing the content of chromium or the purity of the low carbon ferrochrome.

Various Examples of the present invention will be described below specifically.

EXAMPLE 1

30 kg of low carbon ferrochrome of 3 mm or less in particle size, which has a composition as shown in Table 1-(1), was subjected to nitriding and 32.3 kg of ferrochrome nitride [Table 1-(2)] was obtained. Said ferrochrome nitride was crushed into particles of 3 mm or less. 15 kg of particles of ferrochrome nitride was put into 60 l of aqueous solution 3N of $H_2SO_4$ and was subjected to the acid treatment, being stirred for 48 hr. Thereafter, 10.5 kg of ferrochrome nitride was obtained by washing and drying. A composition of said ferrochrome nitride is shown in Table 1-(3). Further, 0.4 wt % of carbon black was added to said ferrochrome nitride and mixed. 10.0 kg of mixture of ferrochrome nitride and carbon black were denitrided by a vacuum treatment at 1250° C. for 24 hr. As a result, lumps of low carbon ferrochrome containing high percentages of Cr as shown in Table 1-(4) were obtained. FCr in Table 1 is an abbreviated description of ferrochrome and the same description will be used in the following Table.

TABLE 1

| Components | (1) Low Carbon FCr (wt. %) | (2) FCr Nitride (wt. %) | (3) FCr Nitride after Acid Treatment (wt. %) | (4) Low Carbon FCr after denitriding (wt. %) |
|---|---|---|---|---|
| Cr | 61.5 | 57.2 | 77.2 | 87.1 |
| Fe | 36.5 | 33.9 | 11.0 | 12.1 |
| N | 0.04 | 6.9 | 10.3 | 0.003 |
| O | 0.10 | 0.15 | 0.54 | 0.032 |
| C | 0.09 | 0.09 | 0.09 | 0.011 |
| Si | 0.72 | 0.68 | 0.20 | 0.23 |
| P | 0.016 | 0.016 | 0.016 | 0.017 |
| S | 0.008 | 0.009 | 0.013 | 0.015 |
| Mn | 0.18 | 0.17 | 0.12 | 0.14 |
| V | 0.13 | 0.12 | 0.13 | 0.14 |
| Ti | 0.001 | 0.001 | 0.001 | 0.001 |
| Co | 0.051 | 0.047 | 0.013 | 0.014 |

In nitriding and crushing low carbon ferrochrome, when particle sizes of low carbon ferrochrome exceed 3 mm, the time of nitriding is greatly prolonged and a ratio of nitriding of low carbon ferrochrome is remarkably decreased. When the particle sizes of ferrochrome nitride are 3 mm or less, an effectiveness in removal of a metal phase by means of acid treatment increases. An amount of acid required for the acid treatment, for example, in case of the use of hydrochloric acid, is quantitatively calculated by the following reaction equations:

$$Fe(s) + 2HCl(l) \rightarrow FeCl_2(l) + H_2(g)$$

$$Cr(s) + 3HCl(l) \rightarrow CrCl_3(l) + 3/2.H_2(g).$$

That is, an excessive amount of acid of 10 to 30% HCl consumed in the above equations is required. When the concentration of an aqueous solution of acid in the acid treatment is less than 1N, an amount of the aqueous solution of acid increases. This affects the manufacturing cost. When the concentration of an aqueous solution of acid exceeds 3N, eluted salts of the metal phase, for example, $FeCl_2$, $FeSO_4$ and hydrates of $FeCl_2$ and $FeSO_4$ precipitate. $FeCl_2$, $FeSO_4$ and hydrates of $FeCl_2$ and $FeSO_4$ adhere to particles of the nitride phase which are to be recovered by means of the acid treatment. This can hinder operations of washing and recovery.

When a percentage of ferrochrome nitride is large in a weight percentage of ferrochrome nitride to an aqueous solution of acid, said salts exceeding the solubility of the salts in the aqueous solution are produced and precipitate. To the contrary, when the percentage of ferrochrome nitride is small in a weight percentage of ferrochrome nitride to the aqueous solution, the amount of the aqueous solution of acid is excessively large. Therefore, the weight percentage of ferrochrome nitride to the aqueous solution was experimentally determined.

As clearly seen from the above-mentioned description, the amount of eluted metal phase is controlled by adjusting the concentration of acid (1N to 3N) and the amount of ferrochrome nitride in the acid treatment. In consequence, the content of Cr in the final product can be adjusted.

EXAMPLE 2

Since low carbon ferrochrome (containing 60 to 70 wt. % Cr) obtained easily for the industrial use is high in ductility and high in strength, powder of the low carbon ferrochrome is hard to obtain by crushing the low carbon ferrochrome and particle sizes of the low carbon ferrochrome are usually of 1 mm or more at a minimum. Ferrochrome nitride, which is obtained by subjecting the low carbon ferrochrome to nitriding, contains 8% nitrogen or less. The ferrochrome nitride has a form of $Cr_2N$ and can be crushed. When the ferrochrome nitride is crushed into particles of 0.3 mm or less and is again subjected to nitriding at 800° to 1200° C., the content of nitrogen is increased to 10 to 14% and the nitride phase takes a form of CrN. When this CrN is compared with said $Cr_2N$, the amount of Fe diffusing in the nitride phase is smaller in CrN than in $Cr_2N$. Accordingly, when the nidride phase takes a form of CrN, Fe is easily removed by means of the acid treatment and low carbon ferrochrome containing small percentages of Fe can be obtained.

Ferrochrome nitride [Table 1-(2)] of −0.3 mm obtained in nitriding and crushing low carbon ferrochrome in the above-mentioned Example 1 was subjected to nitriding at 1000° C. for 24 hr. "−0.3 mm" expresses that the particle size is 0.3 or less. Hereinafter, the same abbreviation will be used. A composition of nitride obtained here is shown in Table 2-(1). This nitride was crushed into paricles of 0.3 mm or less. The crushed nitride was made to react in HCl of a concentration of 3N for 24 hr. A composition of a nitride obtained after having been subjected to acid treatment is shown in Table 2-(2). A mixture obtained by mixing the nitride with 0.7 wt. % of carbon black was denitrided by vacuum treatment at 1250° C. for 24 hr. A component of the mixture is shown in Table 2-(3).

As clearly seen from a comparison of a content of Cr in Table 1-(4) with a content of Cr in Table 2-(3), when low carbon ferrochrome nitride is twice nitrided and crushed as described above, a content of chromium increases.

TABLE 2

| Components | (1) Repeatedly Nitrided FCr (wt. %) | (2) FCr Subjected to Acid Treatment (wt. %) | (3) Denitrided FCr. (wt. %) |
|---|---|---|---|
| Cr | 54.6 | 77.3 | 93.07 |
| Fe | 32.0 | 4.9 | 5.92 |
| N | 11.3 | 15.3 | 0.003 |
| O | 0.42 | 1.18 | 0.046 |
| C | 0.10 | 0.10 | 0.008 |
| Si | 0.66 | 0.09 | 0.015 |
| P | 0.016 | 0.016 | 0.017 |
| S | 0.008 | 0.008 | 0.006 |

EXAMPLE 3

Various sorts of acids are used for industrial purposes, but HCl and $H_2SO_4$ are considered as acids used economically. In case of the use of HCl out of those acids, chlorine can be removed easily during washing and drying after acid treatment. Example 3 relates to a method for decreasing S in products in the case of the use of comparatively cheap $H_2SO_4$. It is found in this method that S can be easily removed by washing the products by aqueous ammonia.

Ferrochrome nitride was made to react in $H_2SO_4$ of a concentration of 3N for 24 hr according to Example 1. Thereafter, acid was removed from ferrochrome nitride by means of decantation. Then, 20 l of water was added to ferrochrome nitride and stirred. Operations of decantation were repeated twice. Thereafter, tests of removal of S were conducted by using three sorts of solutions of aqueous ammonia of 1N, hydrochloric acid of 1N and water. 20 l of each of the solutions were poured into ferrochrome nitride respectively and stirred. Then, the solutions were filtered by decantation. Component S in the nitride obtained as a result of drying is shown in Table 3. As shown in Table 3, $SO_4^{-2}$ ions having adhered to particles are liable to diffuse in aqueous solution by washing with aqueous ammonia. Thereby, the component S in product can be decreased.

TABLE 3

| Washing Conditions | Analysis Values [S] wt % |
|---|---|
| Aqueous Ammonia of 1N | 0.008 |
| Aqueous HCl of 1N | 0.013 |
| Water | 0.032 |

EXAMPLE 4

It is for removing O through reaction C (s)+O (s)→CO (g) to mix carbonaceous material with ferrochrome nitride in denitriding the ferrochrome nitride. It is for decreasing C, O and N to determine a range of particle sizes and temperatures. When a temperature is less than 1100° C., the content of C, O and N is insufficiently decreased as shown in Table 4-(4) for test No. 9. When a temperature is over 1400° C., a decrease of the yield of chromium is produced by volatilization of Cr and there occurs a problem of heat resistance of an apparatus for heating in a vacuum.

Table 4 shows the results of having studied the effects of adding carbon to ferrochrome nitride. In Table 4 (1), it is shown that tests were conducted in both of the cases when carbon was added and not added to ferrochrome nitride. Tests were conducted under conditions of particles of ferrochrome nitride and temperatures shown in (2) and (3) of Table 4, respectively. Product analysis values of ferrochrome as a product and the yield of Cr are shown in (4) and (5) of Table 4, respectively. Retention time was 24 hr at a temperature of heating.

Tests Nos. 1 and 2 of Table 4 show that nitride, which was subjected to acid treatment and to which carbonaceous material was not added, was denitrided, being heated in a vacuum. It is understood in comparison with the case of adding carbonaceous material from the analysis values in Table 4-(4) for Tests Nos. (3) to (8) that, although the content of nitrogen was decreased, oxygen, which had been included into ferrochrome nitride during the acid treatment, cannot be removed.

Tests Nos. 3 to 9 show that carbonaceous material was added to ferrochrome nitride and ferrochrome nitride was denitrided. Tests Nos. 3 to 5 show that particle sizes of ferrochrome nitride were studied. When the particle sizes of ferrochrome nitride were large, C and O remain. Therefore, the particle sizes of ferrochrome nitride were desired to be 0.3 mm or less. In Table 4-(2), 1/0.3 is an abbreviation of the particle sizes of ferrochrome nitride of 0.3 to 1 mm. In Table 6, the same abbreviation also is used. In Nos. 5 to 9 of Table 4, changes were studied depending on temperatures of denitriding. When the temperatures of denitriding were low, the yield of Cr increased, but C, O and N which were impurities, also increased. In view of a balance between the yield of Cr and the impurities, the temperatures of denitriding are required to be within a range of 1100° to 1400° C., and preferred to be within a range of 1150° to 1350° C.

TABLE 4

| Test Nos | (1) Samples | (2) Particle Sizes mm | (3) Temperature °C | (4) Product Analysis Values % C | O | N | (5) Yield of Cr % |
|---|---|---|---|---|---|---|---|
| 1 | Without Coal | −1 | 1250 | 0.002 | 0.32 | 0.005 | 95.5 |
| 2 | Without Coal | −0.15 | 1250 | 0.003 | 0.72 | 0.003 | 99.1 |
| 3 | With Coal | 1/0.3 | 1250 | 0.035 | 0.087 | 0.004 | 99.1 |
| 4 | With Coal | 0.3/0.15 | 1250 | 0.024 | 0.051 | 0.003 | 98.1 |
| 5 | With Coal | −0.15 | 1250 | 0.012 | 0.026 | 0.003 | 98.7 |
| 6 | With Coal | −0.15 | 1400 | 0.004 | 0.023 | 0.003 | 95.5 |
| 7 | With Coal | −0.15 | 1300 | 0.007 | 0.026 | 0.003 | 97.7 |
| 8 | With Coal | −0.15 | 1200 | 0.021 | 0.048 | 0.004 | 98.9 |
| 9 | With Coal | −0.15 | 1100 | 0.19 | 0.37 | 0.52 | 99.4 |

EXAMPLE 5

Figure 2:
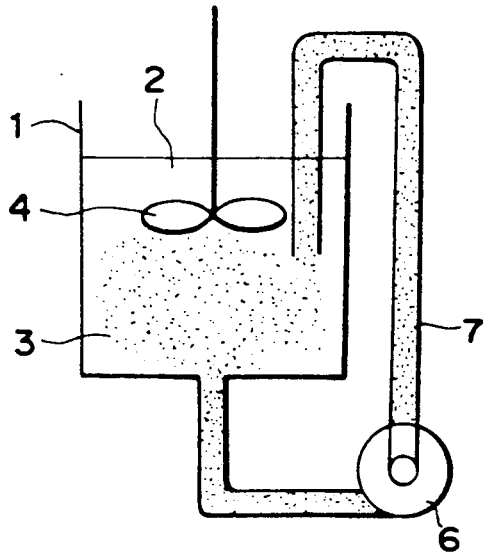
Figure 3:
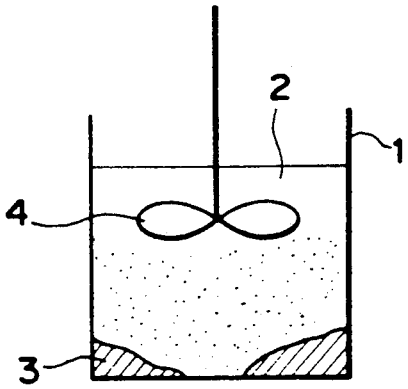
FIGS. 3 and 4 are schematic illustrations showing controls of different ways of stirring, respectively, with regard to said controls.
Figure 4:
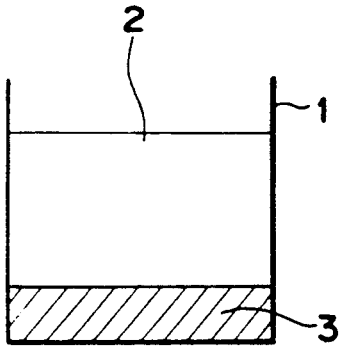

The results of having studied an influence of a stirring method and the particle sizes of ferrochrome nitride in subjecting ferrochrome nitride to an acid treatment while stirring ferrochrome in an acid solution will be described with specific reference to the appended drawings. FIGS. 1 and 2 are schematic illustrations designating stirring methods in an acid treatment which correspond to (1) and (2) of Example 5. FIG. 1 shows a strong stirring method and FIG. 2 a circulation method. FIGS. 3 and 4 are schematic illustrations corresponding to Controls (1) and (2) respectively. In FIGS. 1 to 4, referential numeral 1 denotes a reaction vessel holding acid solution 2 and crushed ferrochrome nitride 3, 4 and 5 denote rotating blades, for stirring inside the reaction vessel. Referential numerals 6 and 7 in FIG. 2 denote a pump and a pipe, respectively, for circulating acid solution respectively.

Example 5-(1) depicted in FIG. 1 is an example wherein a slurry of acid solution and ferrochrome nitride was strongly stirred. Example 5-(2) depicted in FIG. 2 is an example wherein said slurry was stirred, and circulated. Control (1) depicted in FIG. 3 is an example wherein the slurry was stirred by the use of small rotating blades with the low rotating speed of the blades. Control (2) is an example wherein the slurry was not stirred at all. Table 5 shows the most preferable example of the present invention which will be described in detail later in Example 6. In Table 5, (1) shows low carbon ferrochrome used as material, (2) ferrochrome nitride nitrided in nitriding and crushing low carbon ferrochrome, (3) ferrochrome nitride after having been subjected to acid treatment in subjecting ferrochrome nitride to an acid treatment, and (4) a composition of highly pure and high chromium alloy after having been denitrided in denitriding ferrochrome nitride.

TABLE 5

| Components | (1) Low Carbon FCr (wt. %) | (2) FCr Nitride (wt. %) | (3) FCr Nitride after Acid Treatment (wt. %) | (4) Low Carbon FCr after denitriding (wt. %) |
|---|---|---|---|---|
| Cr | 70.5 | 64.9 | 81.1 | 93.4 |
| Fe | 28.1 | 25.8 | 5.7 | 6.5 |
| N | 0.04 | 8.0 | 11.6 | 0.004 |
| O | 0.15 | 0.21 | 1.0 | 0.043 |
| C | 0.09 | 0.09 | 0.11 | 0.006 |
| Si | 0.78 | 0.73 | 0.02 | 0.02 |
| P | 0.018 | 0.018 | 0.003 | 0.003 |
| S | 0.004 | 0.004 | 0.002 | 0.002 |
| Mn | 0.13 | 0.13 | 0.06 | 0.07 |
| V | 0.04 | 0.04 | 0.05 | 0.06 |
| Ti | 0.001 | 0.001 | 0.001 | 0.001 |
| Co | 0.056 | 0.058 | 0.002 | 0.003 |

Ferrochrome nitride of a composition shown in Table 5-(2) was crushed and tests were conducted on three sorts of distributions of particle sizes shown in Table 6. Three sorts of the distributions showing wt. % were obtained by sieving particles of ferrochrome nitride by means of sieves having meshes of 3 mm, 1 mm and 0.15 mm.

TABLE 6

| Distribution | 3/2 | 2/1 | 1/0.5 | 0.5/0.3 | 0.3/0.149 | 0.149/0.074 | 0.074/0.045 | −0.045 |
|---|---|---|---|---|---|---|---|---|
| −3 | 28 | 42 | 25 | 3 | 2 | | | |
| −1 | | | 1 | 25 | 19 | 26 | 13 | 16 |
| −0.15 | | | | | | 36 | 31 | 33 |

Table 7 shows the results obtained by subjecting ferrochrome nitride having a distribution of particle sizes shown in Table 6 to an acid treatment in accordance with said examples 5-(1) and (2) and controls (1) and (2). In Table 7, the yield of chromium, Cr/(Cr+Fe) in products and P and Si which are impurities are shown. The distribution of particle sizes in Table 7-(1) corresponds to the distribution of particle sizes in Table 6.

As clearly seen from the results in Table 7, when the particle sizes of ferrochrome nitride are 1 mm or less, the yield of Cr decreases slightly, but the content of Cr increases and the content of P and S decreases. As clearly seen from comparison of Example 5-(1) and (2) with Control (1) and (2), it is effective to suspend all particles of ferrochrome nitride by combining strong stirring and stirring with a circulation of slurry as in the Examples 5-(1) and -(2).

TABLE 7

| | (1) Distribution of Particle Sizes (mm) | (2) Yield of Cr (%) | (3) Products Cr/Cr + Fe (%) | (4) Impurities (wt. %) P | Si |
|---|---|---|---|---|---|
| Example 5-(1) | −1 | 93.0 | 91.5 | 0.003 | 0.02 |
| | −0.15 | 91.9 | 93.4 | 0.003 | 0.02 |
| Example 5-(2) | −3 | 95.1 | 86.0 | 0.026 | 0.06 |
| | −1 | 92.8 | 92.0 | 0.008 | 0.04 |
| | −0.15 | 92.0 | 93.1 | 0.003 | 0.03 |
| Control (1) | −3 | 94.9 | 85.8 | 0.026 | 0.49 |
| | −1 | 91.2 | 80.0 | 0.021 | 0.20 |
| | −0.15 | 92.9 | 87.6 | 0.010 | 0.08 |
| Control (2) | −3 | 95.2 | 87.0 | 0.020 | 0.38 |
| | −1 | 93.0 | 84.2 | 0.018 | 0.22 |
| | −0.15 | 91.5 | 80.9 | 0.011 | 0.06 |

EXAMPLE 6

Since favorable conditions of stirring in the acid treatment and the particle sizes of ferrochrome nitride are made clear in Example 5, preferable examples of the present invention will be described on the basis of those conditions. Low carbon ferrochrome having a composition shown in Table 5-(1) and a distribution of particle sizes of 3 mm or less were used as a material. Ferrochrome nitride was obtained by subjecting said low carbon ferrochrome to nitriding at 1150° C. in a vacuum heating furnace for 24 hr. Particles of ferrochrome nitride of 1 mm or less (favorable conditions for acid treatment in said Example 5) obtained by crushing ferrochrome nitride were subjected to acid treatment. A composition of ferrochrome nitride before the acid treatment is shown in Table 5-(2).

A reaction vessel used for the acid treatment is the vessel used in Example 5 as shown in FIG. 1. A strong stirring method is used in this reaction vessel. 50 l of water were poured into the reaction vessel with a content volume of 100 l. Subsequently, 12 kg of ferrochrome nitride of 1.0 mm or less in particle size were put into the vessel. Water and ferrochrome nitride were stirred in the reaction vessel by the use of a stirrer having upflow type blades and a capacity of 0.4 kw and rotating at a rate as fast as 250 rpm. A ratio of a rotating diameter of the blade to a diameter of the vessel was 0.85. Further, the total amount of 8 l of 62.5% $H_2SO_4$ was continuously added to a mixture of water and ferrochrome nitride by the use of a quantity measuring pump for 10 hr and was made to react with ferrochrome nitride for 16 hr from the start of adding $H_2SO_4$.

A slurry obtained by the reaction was filtered, washed and recovered as cakes. Then, the cakes were mixed with a solution obtained by adding 0.5 l of aqueous 25% $NH_3$ to 40 l of water and filtered. Thereafter, the cakes were washed and dried. A composition of 7.8 kg of dry substance is shown in Table 5-(3).

Table 8 shows comparisons of the yields of chromium by changing the methods of adding sulfuric acid to ferrochrome nitride in the acid treatment. In Table 8, conditions of Controls (3) and (4) are the same as in Example 5-(1) except for the conditions of adding sulfuric acid to ferrochrome nitride.

It is because the yield of chromium decreases in a reaction of removal of iron when the total amount of $H_2SO_4$ was added to the mixture of water and ferrochrome nitride for a short time as shown in Control 3 of Table 8 that $H_2SO_4$ was continuously added to the mixture of water and ferrochrome nitride. The yield of chromium is desired to be increased by controlling a concentration of $H_2SO_4$ not yet reacted in the reaction vessel by the use of a pH meter. It is for the purpose of decreasing S in products to have added $NH_3$ to repulp water.

TABLE 8

| | Method for Adding Sulfuric Acid | Yield of Chromium (%) |
|---|---|---|
| Example 5-(1) | 8 l of sulfuric acid was continuously added to ferrochrome nitride for 10 hr. Reaction continued for 16 hr. | 92.5 |
| Control 3 | 8 l of sulfuric acid was added to ferrochrome nitride for 10 min. Reaction continued for 16 hr. | 81.3 |
| Control 4 | 8 l of sulfuric acid was added to ferrochrome nitride at the rate of 1 l every 30 minutes. Reaction continued for 16 hr. | 92.0 |

A composition of ferrochrome nitride, from which iron was removed by means of the acid treatment as described above, is shown in Table 5-(3). Ferrochrome nitride was denitrided in such a manner as described below.

0.3 wt % carbon black was added to ferrochrome nitride obtained in subjecting ferrochrome nitride to an acid treatment. A mixture of carbon black and ferrochrome nitride was denitrided by a vacuum treatment at 1350° C. for 24 hr. In this way, high purity chromium alloy of 93.4 wt. % Cr containing a low content of Si, P, S, Ni, Co, Mn, V, C, O and N which were impurities could be obtained.

Examples 5 and 6 show the case when ferrochrome nitride was only once nitrided. The effects of stirring and distribution of particle sizes of ferrochrome nitride in the acid treatment were made clear by comparing the composition of low carbon ferrochrome in Table 5-(4) with that of low carbon ferrochrome in Table 1-(4).

EXAMPLE 7

Example 7 is the most favorable example in view of the purpose of obtaining ferrochrome containing high percentages of Cr and low percentages of impurities since low carbon ferrochrome was nitrided and crushed twice respectively and the acid treatment of ferrochrome nitride was carried out according to said Examples 5 and 6.

30.0 kg of low carbon ferrochrome of 3 mm or less in particle size in a composition shown in Table 9-(1) were subjected to nitriding in a vacuum heating furnace at 1150° C. for 24 hr and 32.4 kg of ferrochrome nitride in Table 9-(2) were obtained. This ferrochrome nitride was crushed into particles of 0.30 mm or less. 30.0 kg of the particles of ferrochrome nitride were repeatedly subjected to nitriding under an atmosphere of nitrogen at 900 Torr in the vacuum heating furnace at 900° C. for 24 hr and 32.0 kg of ferrochrome nitride having a high content of 13.3 wt. % of nitrogen as shown in Table 9-(3) were recovered.

This ferrochrome nitride having a high content of nitrogen was crushed into particles of 0.30 mm or less and subjected to the following acid treatment: 50 l of water were poured into a reaction vessel with a content volume of 100 l. Subsequently, 12 kg of ferrochrome nitride of 0.30 mm or less in particle size were put into the vessel. Water and ferrochrome nitride were stirred in the reaction vessel by the use of a stirrer having upflow type blades as shown in FIG. 1 and a capacity of 0.4 kw and rotating at a rate as fast as 250 rpm. A ratio of a rotating diameter of the blade to a diameter of the vessel was 0.8. Further, the total amount of 8 l of 62.5% $H_2SO_4$ was continuously added to a mixture of water and ferrochrome nitride by the use of a quantity measuring pump for 10 hr and was made to react with ferrochrome nitride for 16 hr from the start of adding $H_2SO_4$.

can be decreased and the yield of chromium can be increased.

TABLE 9

| Components | (1) Low Carbon FCr (wt. %) | (2) FCr Nitrided in One Stage (wt. %) | (3) FCr Nitrided in Two Stages (wt. %) | (4) FCr Nitride after Acid Treatment (wt. %) | (5) Low Carbon FCr after denitrid-ing (wt. %) |
|---|---|---|---|---|---|
| Cr | 70.5 | 65.2 | 61.2 | 78.5 | 99.0 |
| Fe | 28.1 | 26.0 | 24.1 | 0.56 | 0.92 |
| N | 0.04 | 7.5 | 13.3 | 19.8 | 0.004 |
| O | 0.15 | 0.21 | 0.26 | 0.85 | 0.043 |
| C | 0.09 | 0.09 | 0.10 | 0.11 | 0.006 |
| Si | 0.78 | 0.73 | 0.70 | 0.02 | 0.02 |
| P | 0.018 | 0.018 | 0.017 | 0.003 | 0.003 |
| S | 0.004 | 0.004 | 0.004 | 0.002 | 0.002 |
| Mn | 0.13 | 0.13 | 0.12 | 0.06 | 0.07 |
| V | 0.04 | 0.04 | 0.04 | 0.05 | 0.06 |
| Ti | 0.001 | 0.001 | 0.001 | 0.001 | 0.001 |
| Co | 0.056 | 0.058 | 0.055 | 0.001 | 0.001 |

A slurry obtained by the reaction was filtered, washed and recovered as cakes. Then, the cakes were mixed with solution obtained by adding 0.5 l of aqueous 25% $NH_3$ to 40 l of water in the reaction vessel and filtered. Thereafter, the cakes were washed and dried. A composition of 8.0 kg of a dry substance is shown in Table 9-(4). Further, 0.6 wt. % carbon black was added to ferrochrome nitride. A mixture of carbon black and ferrochrome nitride was denitrided by a vacuum treatment at 1350° C. for 24 hr. As a result, 6.2 kg of high purity chromium alloy of 99.0 wt. % Cr containing a low content of Si, P, S, Ni, Co, Mn, V, C, O and N as shown in Table 9-(5) was obtained.

The Example-7 will be described further. Low carbon ferrochrome of 3 mm or less in particle size containing a high content of Cr and a low content of V and Mn is preferred as a starting material. That is, when particle sizes of low carbon ferrochrome are larger than 3 mm, it is difficult for nitrogen to enter low carbon ferrochrome in a nitriding step. In consequence, ferrochrome nitride cannot be crushed economically. When the content of Cr in low carbon ferrochrome is low, the amount of Fe to be removed in the acid treatment becomes large. Ferrochrome containing a higher content of Cr is desirable among low carbon ferrochrome containing 60 to 72% Cr which is usually available. Since Mn and V cannot be removed completely by means of the acid treatment, low carbon ferrochrome containing Mn and V as small as possible is desirable. In this example, however, low carbon ferrochrome usually available in the market place can be used.

The temperature at which low carbon ferrochrome nitride is nitrided is desired to be from 1000° to 1300° C. in the step of nitriding and crushing and from 800° to 1000° C. in the step of subjecting ferrochrome nitride to an acid treatment. A partial pressure to nitrogen is desired to be higher. In any case, operating conditions of temperatures, pressures, time and the like can be determined within a range, in which operations can be economically carried out.

Further, the particle sizes of ferrochrome nitride in the acid treatment are made to be 1 mm or less so that all particles of ferrochrome nitride can be suspended in the reaction vessel. The particles of ferrochrome nitride are made to react with the acid solution by combining the stirring method with the slurry circulation method and by continuously adding sulfuric acid to the particles of ferrochrome nitride. The above-mentioned conditions of acid treatment are favorable since impurities

What is claimed is:

1. A method for manufacturing a low carbon ferrochrome with a high chromium content of at least 70 weight % Cr comprising the steps of:

(a) at least once nitriding and crushing a low carbon ferrochrome to form a crushed ferrochrome nitride;

(b) subjecting said crushed ferrochrome nitride from step (a) to an acid treatment comprising contacting said crushed ferrochrome nitride with an acid solution and stirring the resultant mixture of said ferrochrome nitride and said acid solution, to remove iron; and (c) denitriding the acid treated ferrochrome nitride from step (b) by heating said acid treated ferrochrome nitride from step (b) in a vacuum.

2. The method of claim 1, wherein said nitriding and crushing said low carbon ferrochrome comprise twice nitriding and crushing said low carbon ferrochrome.

3. The method of claim 1, wherein said acid solution comprises an aqueous solution of $H_2SO_4$ and said method further comprises cleaning said acid treated ferrochrome nitride with aqueous ammonia.

4. The method of claim 1, wherein said acid treated ferrochrome nitride has a particle size of 0.3 mm or less and wherein said denitriding further comprises mixing said acid treated ferrochrome nitride from step (b) with a carbonaceous material and denitriding the resultant mixture of said acid treated ferrochrome nitride and said carbonaceous material at a temperature of 1100° to 1400° C.

5. The method of claim 1, wherein said nitriding and crushing said low carbon ferrochrome includes crushing said ferrochrome nitride into particles of 1 mm or less.

6. The method of claim 1, wherein said nitriding and crushing include crushing said ferrochrome nitride into particles of 0.3 mm or less.

7. The method of claim 1, wherein the chromium content of the low carbon ferrochrome with a high chromium content is 70 to 99 weight % Cr.

8. The method of claim 1, wherein the crushed ferrochrome nitride from step (a) comprises a nitride phase of 77 to 81 weight % Cr and a metal phase comprising Fe and 10 to 20 weight % Cr.

9. The method of claim 1, wherein the low carbon ferrochrome comprises at least 50 weight % Cr and no more than 1 weight % C.

10. The method of claim 1, wherein in step (a), the low carbon ferrochrome is crushed into particles of a size of 5 mm or less.

11. The method of claim 10, wherein in step (a), the nitriding is conducted in a vacuum heating furnace which is maintained at a pressure of 0.1 Torr and at a temperature of 1000° to 1300° C. and wherein nitrogen gas is introduced into said vacuum heating furnace to form a ferrochrome nitride comprising 7 to 8 weight % N.

12. The method of claim 4, wherein the temperature is 1150° to 1350° C.

13. The method of claim 1, wherein the acid solution is an aqueous acid solution with an acid concentration of 1N to 3N.

14. The method of claim 12, wherein the acid is HCl.

15. The method of claim 1, wherein the carbonaceous material is selected from the group consisting of carbon black and coal.

16. The method of claim 1, wherein the acid treatment is conducted at a temperature of 800° to 1000° C.

17. The method of claim 1, wherein the acid treatment further comprises circulating a slurry of said mixture of said ferrochrome nitride and said acid solution.

18. The method of claim 1, wherein said nitriding and crushing comprises crushing the low carbon ferrochrome into particles of a size of 1 mm or less and conducting nitriding in a vacuum heating furnace at a temperature of 1000° to 1300° C. in a nitrogen atmosphere;

said acid treatment comprises mixing the crushed ferrochrome nitride from step (a) with an acid solution of $H_2SO_4$ or HCl at a concentration of 1N to 3N at a temperature of 800° to 1000° C.; and said denitriding comprises mixing a carbonaceous material with the acid treated ferrochrome nitride from step (b) and conducting the denitriding at a temperature of 1100° to 1400° with said acid treated ferrochrome having a particle size of 0.3 mm or less.

19. The method of claim 1, wherein the crushed ferrochrome nitride from step (a) comprises a nitride phase of 77 to 81 weight % Cr and a metal phase comprising Fe and 10 to 20 weight % Cr and the low carbon ferrochrome comprises at least 50 weight % Cr and no more than 1 weight % C.

* * * * *